United States Patent [19]

Ogawa

[11] Patent Number: 4,786,588

[45] Date of Patent: Nov. 22, 1988

[54] SILVER HALIDE PHOTOGRAPHIC MATERIALS

[75] Inventor: Tadashi Ogawa, Kanagawa, Japan

[73] Assignee: Fuji Photo Film Co., Ltd., Kanagawa, Japan

[21] Appl. No.: 909,540

[22] Filed: Sep. 22, 1986

[30] Foreign Application Priority Data

| | | | |
|---|---|---|---|
| Sep. 20, 1985 | [JP] | Japan | 60-209803 |
| May 19, 1986 | [JP] | Japan | 61-114273 |
| Jun. 5, 1986 | [JP] | Japan | 61-130736 |

[51] Int. Cl.[4] ..... G03C 1/08

[52] U.S. Cl. ..... 430/603; 430/605; 430/569; 430/567

[58] Field of Search ..... 430/603, 569, 605, 567

[56] References Cited

U.S. PATENT DOCUMENTS

| | | | |
|---|---|---|---|
| 3,501,313 | 3/1970 | Willems et al. | 430/603 |
| 3,503,749 | 3/1970 | Tavernier et al. | 430/603 |
| 3,622,329 | 11/1971 | Huckstadt et al. | 430/603 |
| 3,772,031 | 11/1973 | Berry et al. | 430/603 |
| 4,067,740 | 1/1978 | Bigelow | 430/603 |
| 4,075,020 | 2/1978 | Saleck et al. | 430/569 |
| 4,210,450 | 7/1980 | Corben | 430/569 |
| 4,286,055 | 8/1981 | Forster et al. | 430/603 |

*Primary Examiner*—Won H. Louie

*Attorney, Agent, or Firm*—Sughrue, Mion, Zinn, Macpeak & Seas

[57] ABSTRACT

A water-soluble silver salt and a water-soluble halide are reacted to obtain silver halide particles, and these are, after being demineralized, transhalogenated by adding thereto a water-soluble bromide in an amount of 0.1 mol % to 7 mol % of the total silver halide amount just before or during the sulfur sensitization, to obtain a sulfur-sensitized silver halide emulsion of high sensitivity. The present photographic materials contain the sulfur-sensitized silver halide emulsion and have high sensitivity and excellent pressure characteristics. The transhalogenation along with the sulfur sensitization is effective for the improvement of the sensitivity and the pressure characteristics of the materials.

13 Claims, No Drawings

SILVER HALIDE PHOTOGRAPHIC MATERIALS

FIELD OF THE INVENTION

The present invention relates to silver halide photographic materials, more precisely, to those having high sensitivity and excellent pressure characteristics, and further, to a method for the chemical sensitization of a silver halide emulsion with high sensitivity.

BACKGROUND OF THE INVENTION

Silver halide crystal particles are sensitized by visible rays, ultraviolet rays or other radiation rays to form latent images, which are converted into visible images by development, and, thus, there are various kinds of silver halide photographic materials at present. Usable typical silver halides are silver iodide, silver bromide, silver chloride and mixtures of crystals thereof. The selection of the kind of the silver halide depends upon the use of the photographic materials and the necessary characteristics thereof. For instance, silver iodobromide particles having a relatively large particle size are used in photographic materials for camera films, which generally require a high sensitivity; and silver idodbromide or silver chlorobromide particles having a small particle size are used in photographic materials for duplication or printing, which have relatively low sensitivity. The kind of the silver halide, the shape of the crystal form thereof and the size of the particles are important for the determination of the characteristics of the silver halide emulsion. The matter is described in detail in T. H. James, The *Theory of the Photographic Process,* 4th Ed. (Macmillan Co., Ltd. in N.Y.); and C. Hasse, H. Frieser and E. Klein, *Die Grundlagen der Photographischen Prozesse mit Silberhalogeniden* (Akademische Verlagsgesellschaft, Frankfurt an Main, 1968).

In order to provide silver halide photographic materials of high quality, the necessary factors of the silver halide emulsion are to be properly selected in view of the use of the materials and the necessary characteristics thereof, as described above. However, the selection is not always satisfied with ease. For example, it is said that the photographic materials for prints have relatively low sensitivity, but the recent photographic materials are being required to have high sensitivity, since the printing step and the development step are becoming faster and the time for the exposure is being shortened more and more. The most fundamental means for intensifying the sensitivity of the silver halide emulsions is to enlarge the particle size of the silver halide particles so as to increase the light absorbance per one particle. In the case where the emulsion is color-sensitized, an electron is imparted to the silver halide and the light absorbance of the sensitizer dye which will be indispensable for the formation of latent images may be increased. However, these means are not always satisfactory. Moreover, the enlargement of the particle size often results in the interruption of the acceleration of the development process. The color sensitization will often cause development retardation or desilvering retardation, and, in general, the increment of the amount of the color sensitizer as added is hardly effective for the increment of the sensitivity of the photographic materials. Accordingly, it is considered extremely important to elevate the sensitivity of the silver halide particles without enlargement of the particle size thereof. The silver halides are generally chemically sensitized prior to the actual use thereof, and various chemical sensitization means are known, including, in general, a method using a sulfur sensitizer such as sodium thiosulfate, a method using a gold sensitizer such as potassium chloroaurate, a method involving the formation of reduced and sensitized nuclei and a method comprising a combination of these means.

These conventional means have various problems. In particular, the silver halide particles having the (111) surface are difficultly sensitized by sulfur sensitization as compared to those having (100) surface, and the sensitization efficiency is low when the gold sensitization is not used therewith. Japanese Patent Application (OPI) No. 30748/83 describes an effective sulfur sensitization method to be carried out in the presence of a silver halide solvent (the term "OPI" as used herein refers to a "published unexamined Japanese patent application"). This method is, however, defective in that the fog is not sufficiently lowered at all when silver chlorobromide is used and in that the photographic characteristic is apt to vary quite often after the chemical sensitization. Japanese Patent Application (OPI) No. 125612/83 describes another sulfur sensitization method as characterized by the two-stage constitution of pAg and/or temperature in the sensitization, and this says that the sulfur sensitization for a high silver chloride emulsion is effective. It is to be noted, however, that this method is to merely achieve a general sulfur sensitization level by a general technical means. Also, this method cannot be expected to increase further the sensitivity of the photographic materials. Under the circumstances, any other effective sulfur sensitization is required which is capable of attaining a sufficient increment of the sensitivity of the photographic materials.

SUMMARY OF THE INVENTION

Accordingly, the object of the present invention is to provide a method for the chemical sensitization of silver halide emulsions with high sensitivity and, in addition, to provide silver halide photographic materials containing a sulfur-sensitized emulsion of high sensitivity.

In order to attain the objects, the present invention provides a silver halide photographic material comprising a support having provided thereon a sulfur-sensitized silver halide emulsion, wherein the silver halide particles in the emulsion as formed by the reaction of a water-soluble silver salt and a water-soluble halide are, after demineralization, subjected to transhalogenation along with sulfur sensitization by the addition of a water-soluble bromide to the emulsion in an amount of 0.1 mol % to 7 mol % of the total amount of the silver halide therein just before or during the sulfur sensitization.

DETAILED DESCRIPTION OF THE INVENTION

The water-soluble bromides are those to free the bromide ion in an aqueous solution, and, for example, alkali metal or ammonium bromides such as potassium bromide, sodium bromide or ammonium bromide are usable. According to the present invention, the silver halide particles are necessarily subjected to transhalogenation by the water-soluble bromide as added, and, therefore, the silver halide particles before the transhalogenation contain a relatively easily soluble silver salt so that these may form a sparingly soluble silver salt by the transhalogenation. For example, the silver halide grains comprise silver chloride before the transhalogenation, which is converted into silver bromide by bromide ion after the transhalogenation. The content of silver chloride may vary within the range of from 0% up to 100 mol % (exclusive of 0%) and is preferably 4 mol % or more. The amount of the silver chloride to be converted into silver bromide may be a part or almost all of the original content thereof. The amount of the water-soluble bromide to be added is not less than but may be more than the amount of the silver chloride to be converted, with the proviso that the amount must fall within the range of 0.1 mol % to 7 mol % of the total amount of the silver halide. More preferably the amount is within the range of 0.2 mol % to 3 mol %.

The addition of the water-soluble bromide has two effects on the emulsion. One is to elevate the pAg value of the emulsion, and the other is to cause the transhalogenation. These two actions are not unrelated to each other. In particular, the pAg value of the emulsion is high in the stage where the transhalogenation is not proceeding sufficiently yet. The bromide ion as added reacts with the free silver ion in the emulsion to form a sparingly soluble silver salt or silver bromide, whereby the silver ion concentration is lowered and the pAg value is elevated. The formed silver bromide precipitates on the surface of the silver halide particles, and on the other hand, a large amount of the other bromide ions which do not directly react with the free silver ion to form silver bromide approach near to the surface of the silver halide particles and are substituted for the chloride ion to form silver bromide, whereupon the chloride ion is released. The silver ion concentration in the emulsion varies in accordance with the integrated value of the halogen composition in the transhalogenated silver halide particles, especially that of the halogen composition in the surface of the particles, and the amount of the bromide ion that remained in the liquid. The variation of the pAg value means the variation of the free silver ion concentration in the liquid where the silver halide particles in the emulsion are suspended, and this has no direct relation to the variation of the silver halide particles themselves as transhalogenated.

In the present invention, the variation of the pAg value itself by the addition of the water-soluble bromide is not so important. This is because the addition of a water-soluble chloride will cause the same variation of the pAg value but cannot yield the effect of the present invention, for example, to achieve the high sensitivity. On the contrary, the addition of the water-soluble chloride will rather cause reduction of the sensitivity because of the retardation of the chemical ripening. In view of this fact, it is apparent that the present invention is quite different from that of Japanese Patent Application (OPI) No. 125612/83 which is directed to the variation of the pAg value itself.

In the present invention, the transhalogenation itself is inherently important. The transhalogenation is attained by the addition of a halogen ion capable of forming a more sparingly soluble silver halide to obtain a water-insoluble silver halide. On the other hand, it is not impossible to obtain a sparingly soluble silver salt by the addition of a halogen ion capable of forming a more soluble silver halide. For example, it is possible to convert a part of silver bromide contained in silver halide particles into silver chloride by the addition of a large amount of a water-soluble chloride to the silver bromide-containing silver halide particles. In the latter case, however, the transhalogenation will be accompanied by not only the variation of the particle size but also the extreme increment of the pAg value, and if the chemical sensitization is carried out under such conditions, the effect of the present invention cannot be attained.

The halogen ions capable of forming more sparingly soluble silver halides include iodide ion, but the iodide ion is not always preferable because the use of the iodide ion is apt to cause an uneven transhalogenation in the particles and is apt to cause a retardation of the chemical ripening, and, further, the use thereof is difficult to obtain the elevation of the sensitivity which is comparable to that obtained by the transhalogenation with a bromide.

In the present invention, it is important to provide silver halide particles which are being transhalogenated during the sulfur sensitization. The sulfur sensitization will begin just upon the addition of a sulfur sensitizer to the emulsion so far as the reaction condition is satisfied for the sulfur sensitization, and this proceeds with the progress of time depending upon the property of the particles in the emulsion, the pAg value and the temperature thereof. Accordingly, the effect of the present invention may be attained only under the condition that the period of the progress of the sulfur sensitization reaction overlaps with that of the progress of the transhalogenation reaction, but if these do not overlap with each other, the effect of the present invention cannot be attained. For example, if the sulfur sensitizer is added after a long period of time from the addition of the water-soluble bromide to the emulsion (or, that is, after the disappearance of the variation of the pAg value in the emulsion), the effect for the elevation of the sensitivity almost can not be attained, but, on the contrary, if the water-soluble bromide is added to the emulsion after the complete ripening thereof to cause the arrival of the maximum sensitivity by the previous addition of the sulfur sensitizer to the emulsion, the sensitivity of the emulsion is not elevated but is rather lowered. Only when the water-soluble bromide is added to the emulsion during a pertinent and intermediate period in the progress of the sulfur sensitization and the progress of the transhalogenation, a higher sensitivity can be obtained than the maximum sensitivity obtainable by ripening only with the sulfur sensitizer. More preferably, the sulfur sensitization reaction and the transhalogenation reaction proceed at the same time, and most preferably the transhalogenation may just proceed when sensitized nuclei are beginning to be formed on the surface of the silver halide particles by the sulfur sensitization reaction. The present invention specifically defines that the water-soluble bromide is to be added just before the sulfur sensitization, which means that the bromide is to be added within the period of time when the above-mentioned state is beginning to appear.

After the transhalogenation of the silver halide particles by the addition of the water-soluble bromide, it is considered that the recrystallization of the particles will occur simultaneously or successively. This is the change for the arrival to the interparticle or intraparticle thermodynamic equilibrium between the part containing the crystals of a high silver bromide content as formed by the direct transhalogenation and the part containing the crystals of a low silver bromide content (which is near to the original halogen composition) which were not directly transhalogenated but dissolved, while donating silver ion to the emulsion. As mentioned above, if the sulfur sensitizer is added after a long period of time from the addition of the water-soluble bromide to the emulsion, the addition of the water-soluble bromide is almost ineffective for elevation of the sensitivity, but if an increased amount of the water-soluble bromide is added within the period of time while the sensitization somewhat proceeds and the sulfur sensitization is continued, an accelerated elevation of the sensitivity is possible. However, the important points in this case are that a larger amount of the water-soluble bromide must be added than in the case for attaining the same degree of sensitivity increment where the sulfur sensitizer is added immediately after the addition of the water-soluble bromide to the emulsion and that the emulsion to which was added such a large amount of the water-soluble bromide is, after being coated on a support, apt to be desensitized because of the mechanical pressure (such as scratch or bending) imparted thereto. Thus, the use of this kind of emulsion will give a serious defect to the photographic materials.

Regarding the preparation of silver halide emulsion particles, U.S. Pat. No. 2,592,250 describes a known transhalogenation method. According to this known method, however, the coated emulsion is apt to desensitize under mechanical pressure to cause the decrement of the sensitivity of the formed negative image. If, on the contrary, the transhalogenation is carried out under such conditions that the transhalogenation does not cause the desensitization under pressure, the transhalogenated emulsion does not have the necessary characteristics. Thus, the present inventors have found that this known transhalogenation method is ineffective.

According to the method of the present invention, desensitization of the emulsion under pressure does not occur, and the sensitivity of the emulsion, after sulfur sensitization, increases greatly. The effect of the present invention cannot be attained by the conventional means where the transhalogenation and the chemical sensitization are almost separately carried out and is quite unexpected therefrom.

The amount of the water-soluble bromide to be added for the transhalogenation during the sulfur sensitization, according to the present invention, is 0.1 mol % to 7 mol %, more preferably 0.2 mol % to 3 mol %, to the total amount of the silver halide contained in the emulsion. If the amount is less than the above range, the effect of the present invention cannot be attained, but on the contrary, if the amount is more than the above range, desensitization under pressure occurs and retardation of the chemical ripening becomes remarkable. Thus, the use of the bromide overstepping the range is not preferable.

The sulfur sensitization may be carried out in accordance with a conventional sulfur sensitization process. For example, sulfur-containing compounds capable of reacting with silver halides may be used, including thiosulfates, thioureas, mercapto compounds and rhodanines. The details of the sulfur sensitization process are described in U.S. Pat. Nos. 2,410,689 and 3,501,313, German Pat. No. 1,422,869 and Japanese Patent Publication No. 20533/74.

The sulfur sensitizer is preferably used in an amount of about $10^{-8}$ to $5\times10^{-4}$ mol per one mol of the silver halide. The sensitization (ripening) is preferably carried out at about 45° C. to 75° C. for about 5 to 120 minutes.

In addition, other sensitization means may be carried out along with the present sulfur sensitization.

For example, a reduction sensitization by the use of a reducing substance (such as stannous salts, amines, hydrazine derivatives, formamidine-sulfinic acids, silane compounds) or a noble metal sensitization by the use of a noble metal (such as gold complexes as well as complexes of Pt, Ir, Pd or other group VIII metals) may be combined with the sulfur sensitization.

The reduction sensitization and the noble metal sensitization are described, for example, in U.S. Pat. Nos. 2,399,083, 2,597,856, 2,597,915, 2,487,850 and 2,518,698.

The demineralization can be carried out in accordance with various known methods such as a method using washing with water (e.g., noodle washing), a method using a precipitating medium, and so on.

The silver halides which are preferably used in the present invention are silver chloro(iodo)bromide or silver (iodo)bromide which does not contain silver iodide or, if any, contains 3 mol % or less silver iodide. The silver halide particles of the present invention are composed of different inner phase and outer surface phase, and in addition, these may comprise an epitaxial structure of a multiphase structure or the whole of each particle may comprise a homogeneous phase except for the surface layer thereof. The particles may comprise a mixture of these structural forms. For example, regarding silver chlorobromide particles having different phases, the particle may contain a nucleus or a single or plural layers having a higher silver bromide content than the average halide composition, or otherwise, may contain a nucleus or a single or plural layers having a higher silver chloride content than the average halide composition. The average particle size of the silver halide particles is preferably 0.1 μm to 2 μm, especially preferably 0.15 μm to 1 μm. (The particle size is represented by the diameter of the particle in the case of spherical or nearly spherical particles or is represented by the length of the edge in the case of cubic particles, and the calculation of the average particle size is based on the projected areas of the particles.) So-called monodispersed silver halide emulsions are preferably used in the present invention. The degree of the monodispersion which is represented by a variation coefficient (corresponding to the value of the standard deviation of the particle distribution curve of the silver halide particles as divided by the average particle size) is preferably 0.15 or less, more preferably 0.10 or less. Two or more monodispersed silver halide emulsions each having a different particle size may be blended and coated to form one layer or each of these monodispersed emulsions may be separately coated to form a multilaminate layer having a substantially uniform color sensitivity in order to satisfy the desired gradation in the photographic material. Otherwise, two or more polydispersed silver halide emulsions or a mixture of a monodispersed emulsion and a polydispersed emulsion may be blended and coated to form one layer or may separately be coated to form a multilaminate layer.

The shape of the silver halide particles to be used in the present invention is preferably a regular crystalline form such as a cubic, octahedral, dodecahedral, or tetradecahedral crystalline form, but the particles may have spherical or other irregular crystalline forms, or otherwise, may comprise composite crystalline forms. The particles may be tabular ones. An emulsion containing tabular particles having an aspect ratio (length/thickness) of 5 or more, especially 8 or more, in an amount of 50% or more of the total projected area of the particles may be used. The emulsion may comprise a mixture of these various kinds of crystalline forms. The emulsions may be either a surface latent image type emulsion which forms a latent image mainly on the surface of the particles or an inner latent image type emulsion which forms a latent image mainly in the inner part of the particles.

The photographic emulsions to be used in the present invention may be prepared in accordance with known methods as described, for example, in P. Glafkides, *Chimie et Physique Photographique* (published by Paul Montel, 1967), G. F. Duffin, *Photographic Emulsion Chemistry* (published by Focal Press, 1966), and V. L. Zelikman et al., *Making and Coating Photographic Emulsion* (published by Focal Press, 1964). For instance, any of an acid method, a neutral method or an ammonia method may be used, and in addition, a single jet method, a double jet method or a combination thereof may be used for the reaction of a soluble silver salt and a soluble halide. A so-called reverse mixing method in which silver halide particles are formed in the presence of an excess silver ion may also be used. In addition, a so-called controlled double jet method, which is one type of a double jet method, may also be used, where the pAg value in the liquid phase to form silver halide particles is kept constant. According to this method, an emulsion containing silver halide particles having a nearly regular crystalline form and a nearly uniform particle size may be obtained.

Additives to be used in the preparation of the silver halide emulsions of the present invention will be described below.

In the formation of the silver halide particles, in accordance with the present invention, a silver halide solvent may be used in order to properly control the growth of the particles. Usable solvents are, for example, ammonia, potassium thiocyanate, ammonium thiocyanate and thioether compounds (as described, for example, in U.S. Pat. Nos. 3,271,157, 3,574,628, 3,704,130, 4,297,439 and 4,276,374); thione compounds (as described, for example, in Japanese Patent Application (OPI) Nos. 144319/78, 82408/78 and 77737/80); and amine compounds(as described, for example, in Japanese Patent Application (OPI) No. 100717/79).

In the step of the formation of the silver halide particles or the step of the physical ripening thereof, a cadmium salt, a zinc salt, a thallium salt, an iridium salt or a complex thereof, a rhodium salt or a complex thereof or an iron salt or a complex thereof may be used.

The photographic emulsions of the present invention may contain various kinds of compounds for the purpose of the prevention of fog in the manufacture, preservation or photographic processing of the photographic materials or for the stabilization of the photographic characteristics of the materials. For example, various kinds of compounds which are known as antifogging agents, or stabilizers may be used therefor, including azoles such as benzothiazolium salts, nitroindazoles, triazoles, benzotriazoles, benzimidazoles (especially nitro- or halogen-substituted derivatives); heterocyclic mercapto compounds such as mercaptothiazoles, mercaptobenzothiazoles, mercaptobenzimidazoles, mercaptothiadiazoles, mercaptotetrazoles (especially 1-phenyl-5-mercaptotetrazole), mercaptopyrimidines; the aforesaid heterocyclic mercapto compounds containing a water-soluble group such as carboxyl group or sulfo group; thioketo compounds such as oxazolinethione; azaindenes such as tetraazaindenes (especially 4-hydroxy-substituted (1,3,3a,7)tetraazaindenes); benzenethiosulfonic acids; benzenesulfinic acids, etc.

The silver halide photographic emulsions of the present invention may contain a color coupler such as a cyan coupler, a magenta coupler and a yellow coupler as well as a compound for dispersing the coupler.

More precisely, the emulsions may contain a compound capable of coloring by the oxidation coupling with an aromatic primary amine developing agent (such as phenylenediamine derivatives or aminophenol derivatives) in the color development process. Examples of magenta couplers are 5-pyrazole couplers and pyrazoloazole couplers; examples of yellow couplers are acylacetamide couplers (such as benzoylacetanilides or pivaloylacetanilides); and examples of cyan couplers are naphthol couplers and phenol couplers. These couplers are preferably nondiffusible, as containing a hydrophobic group, which is called a ballast group, in the molecule. The couplers may be either 4-equivalent or 2-equivalent to the silver ion. Further, the couplers may be a colored coupler having a color correctability or a coupler capable of releasing a development inhibitor in the development procedure (a so-called DIR coupler).

The emulsions may contain a noncoloring DIR coupler compound which may form a colorless product in the coupling reaction and which may release a development inhibitor, except for the DIR coupler.

The photographic emulsions of the present invention may further contain various compounds for the purpose of elevation of the sensitivity, the intensification of the contrast and the acceleration of the development, for example, polyalkylene oxides and ether, ester or amine derivatives thereof and thioether compounds, thiomorpholines, quaternary ammonium salt compounds, urethane derivatives, urea derivatives, imidazole derivatives and 3-pyrazolidones.

The silver halide photographic emulsions of the present invention may contain, as a filter dye or for the purpose of irradiation prevention or for other various purposes, a known water-soluble dye (such as oxonol dyes, hemioxonol dyes and merocyanine dyes). Further, a cyanine dye, a merocyanine dye or a hemicyanine dye may be added to the emulsion before, during or after the chemical sensitization thereof, as a spectral sensitizer or for the purpose of properly controlling the crystal form or the size of the silver halides.

The photographic emulsions of the present invention may contain various kinds of surfactants for the purpose of coating aid, static charge prevention, improvement of slide properties, emulsification and dispersion, blocking inhibition and improvement of photographic properties (e.g., acceleration of development, intensification of contrast and sensitization).

The photographic materials of the present invention may contain various additives such as discoloration inhibitors, hardeners, color fog inhibitors, ultraviolet absorbents and protective colloids (e.g., gelatin). These additives are concretely described, for example, in *Research Disclosure* (RD-17643), Vol. 176 (1978, XII).

The finished emulsion is coated on a suitable support such as baryta paper, resin-coated paper, synthetic paper, triacetate film, polyethylene terephthalate film or other plastic base or glass plate.

The silver halide photographic materials of the present invention have various uses and may be used, for example, as color positive films, color papers, color negative films, color reversal films (containing or not containing a coupler), light-sensitive materials for photomechanical processing (e.g., lith films, lith dupe films), light-sensitive materials for cathode tube display, light-sensitive materials for X-ray recording, light-sensitive materials for a silver salt diffusion transfer process, light-sensitive materials for a color diffusion transfer process, light-sensitive materials for an imbibition transfer process, emulsions for use in a silver dye bleaching method, light-sensitive materials for recording print-out images, light-sensitive materials for direct print images, light-sensitive materials for heat development and light-sensitive materials for physical development.

The exposure for the formation of photographic images may be carried out in a conventional manner. For example, various kinds of known light sources may be used therefor, including natural light (sunlight), a tungsten lamp, a fluorescent lamp, a mercury lamp, a xenon arc lamp, a carbon arc lamp, a xenon flash lamp, a cathode ray tube flying spit, etc. Regarding the exposure time, the time is generally within the range of from 1/1,000 sec to 1 sec when a film is exposed with a general camera, or the time may be shorter than 1/1,000 sec, for example, within the range of $1/10^6$ to $10^4$ sec, when exposed with a xenon arc lamp or a cathode ray. As the case may be, the exposure may be longer than 1 sec. If necessary, a color filter may be used for regulating the spectral composition of the light to be used for the exposure. Laser rays may be used for the exposure. Further, the exposure may be carried out by the use of a light as emitted from a fluorescent substance excited with an electron ray, X-ray, $\gamma$-ray or $\alpha$-ray.

For the photographic processing of the present photographic materials, any conventional means and conventional processing solutions may be used, which are described, for example, in *Research Disclosure* (RD-17643), No. 176, pp. 28–30. The photographic processing may be either a black-and-white photographic processing to form silver images or a color photographic processing to form color images, and the means may be selected in accordance with the object and the use of the materials to be processed. The processing temperature is generally selected from the range of 18° C. to 50° C., and, if necessary, the temperature may be lower than 18° C. or higher than 50° C.

The present invention will be explained in greater detail by reference to the following examples, which, however, are not intended to be interpreted as limiting the scope of the present invention.

EXAMPLE 1

30 g of lime-processed gelatin was added to 1,000 ml of distilled water and, after being dissolved at 40° C., 6.5 g of sodium chloride was added thereto and the temperature was elevated to 75° C. A solution of 62.5 g of silver nitrate dissolved in 750 ml of distilled water and a solution of 30.6 g of potassium bromide and 6.5 g of sodium chloride dissolved in 500 ml of distilled water were added to the previously prepared solution and blended in the course of 40 minutes, while being kept at 75° C. Further, a solution of 62.5 g of silver nitrate dissolved in 500 ml of distilled water and a solution of 30.6 g of potassium bromide and 6.5 g of sodium chloride as dissolved in 300 ml of distilled water were added thereto and blended in the course of 20 minutes, while being kept at 75° C. The formed silver chlorobromide emulsion (silver bromide: 70 mol %) was demineralized and washed with water, and this was divided into 8 parts. Each of the emulsion samples was chemically sensitized under the conditions as shown in the following Table 1. (In the chemical sensitization of Emulsions (B) through (H), potassium bromide or sodium chloride was simultaneously added.) Each of the thus processed Emulsions (A) through (H) was coated on a cellulose triacetate base, the coated silver amount being 3.5 g/m$^2$ and the coated gelatin amount being 5 g/m$^2$. The coated film was exposed with a white light of 5,400° K. through a continuous wedge for 1 second and thereafter developed with the following developer at 20° C. for 10 minutes. The photographic density was measured with a densitometer, and the results are given in Table 1.

| Developer: | |
|---|---|
| Ascorbic Acid | 10 g |
| p-Methylaminopherol | 2.4 g |
| Sodium Carbonate | 10 g |
| Potassium Bromide | 1 g |
| Water to make | 1 liter |

TABLE 1

| | Condition in Chemical Ripening*1 (60° C., 40 minutes) | | | Results | | | |
|---|---|---|---|---|---|---|---|
| Emulsion | Sodium Thiosulfate (mg) | Potassium Bromide (g) | Sodium Chloride (g) | Sensitivity | Fog | Desensitization by Pressure | Remarks |
| (A) | 0.75 | — | — | 100 | 0.02 | 94 | Comparison |
| (B) | " | 0.005 (0.05)*2 | — | 100 | 0.02 | 94 | Comparison |
| (C) | " | 0.022 (0.2) | — | 112 | 0.02 | 94 | Invention |
| (D) | " | 0.16 (1.5) | — | 182 | 0.02 | 92 | Invention |
| (E) | " | 0.65 (6.0) | — | 234 | 0.02 | 90 | Invention |
| (F) | " | 0.98 (9.0) | — | 153 | 0.02 | 78 | Comparison |
| (G) | " | — | 0.079 | 100 | 0.02 | 94 | Comparison |
| (H) | " | — | 0.48 | 92 | 0.02 | 92 | Comparison |

*1Sodium thiosulfate and potassium bromide or sodium chloride were simultaneously added.
*2Mol % to the total silver halide amount.

For the measurement of the desensitization by pressure, the sample was folded at an angle of 90° and then exposed and developed. The relative value of the density of 0.4 was set at 100. The density of the folded part was measured and the relative value thereof was calculated on the basis of the previously set relative value of 100. The above Table 1 proves that the sensitivity of Emulsions (B) through (F) greatly increased by the sulfur sensitization with the addition of potassium bromide. However, it is noted that the addition of too much bromide (as in Emulsion (F)) will cause the desensitization by pressure despite the increment of the sensitivity itself.

EXAMPLE 2

The emulsion as prepared in the same manner as in Example 1 was demineralized and washed with water, and then divided into 6 parts. Each sample was chemically sensitized under the conditions as shown in the following Table 2. Emulsions (I) through (N) were coated, exposed and developed, and the results are also given in Table 2.

TABLE 2

| Emulsion | Condition in Chemical Ripening (60° C., 40 minutes) Sodium Thiosulfate (mg) | Potassium Bromide (g) | Results Sensitivity | Fog | Desensitization by Pressure | Remarks |
|---|---|---|---|---|---|---|
| (I) | 1.0 | — | 100 | 0.02 | 94 | Comparison |
| (J) | " | 0.21 (⊖ 20 min) | 103 | 0.02 | 94 | Compraison |
| (K) | " | 0.21 (⊖ 2 min) | 192 | 0.02 | 92 | Invention |
| (L) | " | 0.21 (0 min) | 182 | 0.02 | 92 | Invention |
| (M) | " | 0.21 (⊕ 15 min) | 176 | 0.02 | 90 | Invention |
| (N) | " | 0.21 (⊕ 45 min) | 86 | 0.02 | 89 | Comparison |

The time as shown in the column of potassium bromide means the time of the addition of the potassium bromide, which was counted on the basis of the added time (0 min) of sodium thiosulfate. ⊖ means "before" and ⊕ means "after". 0.21 g of potassium bromide corresponds to 0.1 mol % of the total silver halide amount.

In the processing of Emulsion (J), the addition of the potassium bromide was too early, before the beginning of the sulfur sensitization and, therefore, this Emulsion (J) could not be sensitized sufficiently. On the contrary, if the potassium bromide was added after the finish of the sulfur sensitization, as in the processing of Emulsion (N), the sensitivity of the emulsion could not be elevated but rather was deteriorated.

EXAMPLE 3

30 g of lime-processed gelatin was added to 1,000 ml of distilled water and, after being dissolved at 40° C., 6.5 g of sodium chloride was added thereto and the temperature was elevated to 70° C. A solution of 62.5 g of silver nitrate dissolved in 750 ml of distilled water and a solution of 21.9 g of potassium bromide and 10.8 g of sodium chloride dissolved in 500 ml of distilled water were added to the previously prepared solution and blended in the course of 40 minutes, while being kept at 70° C. Further, a solution of 62.5 g of silver nitrate dissolved in 500 ml of distilled water and a solution of 21.9 g of potassium bromide and 10.8 g of sodium chloride dissolved in 300 ml of distilled water were added thereto and blended in the course of 20 minutes, while being kept at 70° C.

This emulsion and the emulsion as used in Example 1 and a pure silver bromide emulsion having the same particle size (which was prepared by means of a controlled double jet method) each were divided into two parts. The emulsions were, after being demineralized and washed with water, chemically sensitized. These were Emulsion Samples (Q) through (T). Each of these emulsions was coated, exposed and developed. The results are given in the following Table 3.

Emulsion (T) comprising pure silver bromide was noted quite ineffective by the process of the present invention.

TABLE 3

| Emulsion | Condition in Chemical Ripening (60° C., 40 minutes) Sodium Thiosulfate (mg) | Potassium Bromide (g) | Results Sensitivity | Fog | Remarks |
|---|---|---|---|---|---|
| (O) | 3 | — | 100 | 0.02 | Comparison |
| (P) | " | 0.64 | 245 | 0.02 | Invention |
| (Q) | " | — | 100 | 0.02 | Comparison |
| (R) | " | 0.64 | 182 | 0.02 | Invention |
| (S) | " | — | 100 | 0.02 | Comparison |
| (T) | " | 0.64 | 84 | 0.02 | Comparison |

0.64 g of potassium bromide corresponds to 1.5 mol % of the total silver halide amount. Emulsions (Q) and (R) are those of Example 1.

EXAMPLE 4

In the same manner as in Example 1, with the exception that the amount of potassium bromide and that of sodium chloride in the formerly added halide aqueous solution were changed to 35.0 g and 4.3 g, respectively, that these amounts in the latter added halide aqueous solution were changed to 26.3 g and 8.6 g, respectively, and that the reaction temperature was elevated to 77.5° C., an emulsion was prepared. This was, after being demineralized and washed with water, divided into two parts. These emulsions were chemically sensitized in the same manner as Emulsions (O) and (P) in Example 3 to obtain Emulsions (U) and (V), respectively. When the sensitivity of Emulsion (U) was set at 100, the relative sensitivity of Emulsion (V) was 144. (Emulsion (U) is a comparative sample and Emulsion (V) is the present sample.)

EXAMPLE 5

On a paper support laminated with polyethylene on both sides were coated the first layer to the seventh layer described below to prepare a color light-sensitive material. The polyethylene laminate provided on the side where the first layer was coated contained titanium dioxide and a slight amount of ultramarine.

Constitution of Light-Sensitive Film

The number corresponding to each component means the coated amount, which is represented by the unit "g/m$^2$". The amount of the silver halide is represented in terms of the amount of the coated silver.

| First Layer: Blue-Sensitive Layer | |
|---|---|
| Silver chlorobromide emulsion (silver bromide: 80 mol %) | 0.30 (silver) |
| Yellow coupler (*1) | 0.70 |
| Coupler solvent for the above (TNP) | 0.15 |

-continued

| | |
|---|---|
| Gelatin | 1.20 |
| **Second Layer: Intermediate Layer** | |
| Gelatin | 0.90 |
| Di-t-octylhydroquinone | 0.05 |
| Solvent for the above (DBP) | 0.10 |
| **Third Layer: Green-Sensitive Layer** | |
| Silver chlorobromide emulsion (Emulsion (A) or (D) in Example 1) | 0.45 (silver) |
| Magenta coupler (*2) | 0.35 |
| Coupler solvent for the above (TOP) | 0.44 |
| Discoloration inhibitor (*3/*4) | 0.05/0.10 |
| Gelatin | 1.00 |
| **Fourth Layer: Ultraviolet Absorbent Intermediate Layer** | |
| Ultraviolet absorbent (*5/*6/*7) | 0.06/0.25/0.25 |
| Solvent for the above (TNP) | 0.20 |
| Gelatin | 1.5 |

-continued

| | |
|---|---|
| **Fifth Layer: Red-Sensitive Layer** | |
| Silver chlorobromide emulsion (silver bromide: 50 mol %) | 0.20 (silver) |
| Cyan coupler (*8/*9) | 0.2/0.2 |
| Coupler solvent for the above (TNP/DBP) | 0.10/0.20 |
| Gelatin | 0.9 |
| **Sixth Layer: Ultraviolet Absorbent Intermediate Layer** | |
| Ultraviolet absorbent (*5/*6/*7) | 0.06/0.25/0.25 |
| Solvent for the above (DBP) | 0.20 |
| Gelatin | 1.5 |
| **Seventh Layer: Protective Layer** | |
| Gelatin | 1.5 |

DBP is dibutyl phthalate, TOP is tri(n-octyl) phosphate, and TNP is tri(n-nonyl) phosphate.

The others are as follows:

(*1)

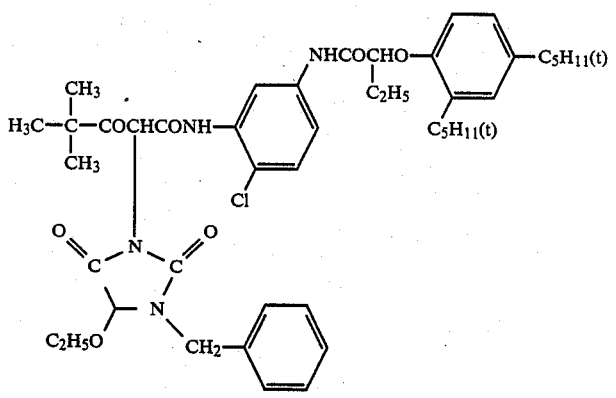

(*2)

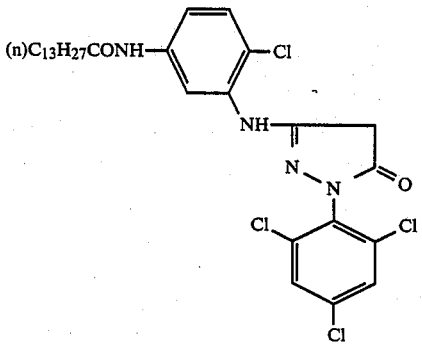

(*3)

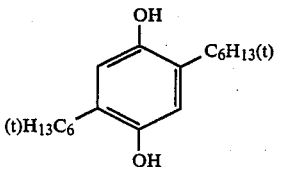

(*4)

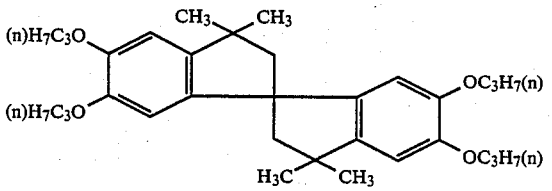

(*5)

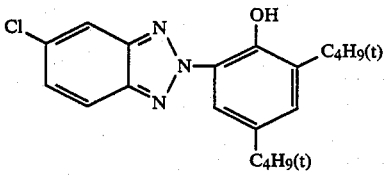

(*6)

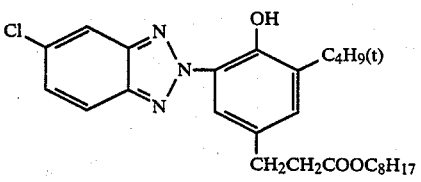

-continued

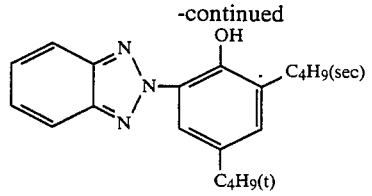

(*7)

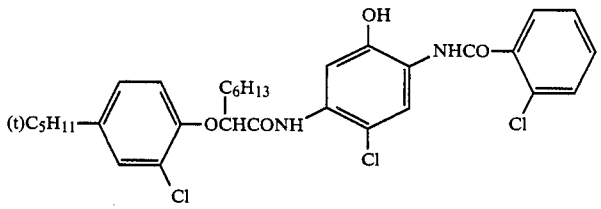

(*8)

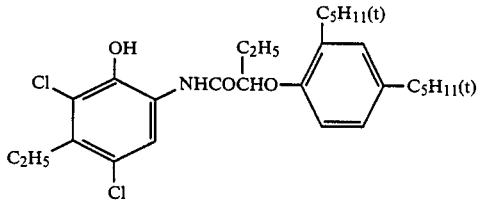

(*9)

The following spectral sensitizer dye was added to each light-sensitive emulsion layer:

Blue-Sensitive Emulsion Layer: Triethylammonium 4-{5-chloro-2-[5-chloro-3-(4-sulfonatobutyl)benzothiazolin-2-ylidenemethyl]-3-benzothiazolio}butanesulfonate ($2\times10^{-4}$ mol per mol of silver halide)

Green-Sensitive Emulsion Layer: Sodium 3,3'-di(γ-sulfopropyl)-5,5'-diphenyl-9-ethyloxacarbocyanine ($2.5\times10^{-4}$ mol per mol of silver halide)

Red-Sensitive Emulsion Layer: Sodium 3,3'-di(γ-sulfopropyl)-10-methylthiadicarbocyanine ($2.5\times10^{-4}$ mol per mol of silver halide)

The following irradiation inhibiting dye was added to each light-sensitive emulsion layer:

Green-Sensitive Emulsion Layer

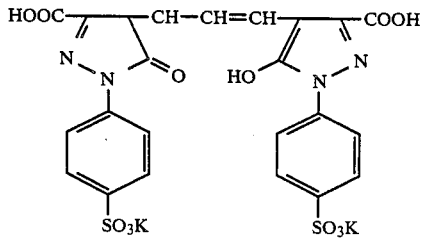

Red-Sensitive Emulsion Layer

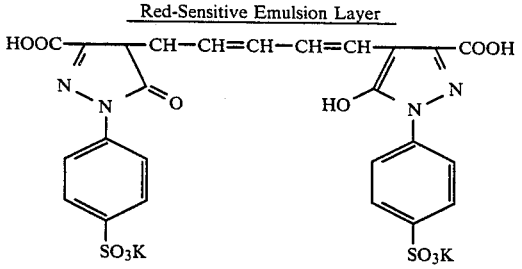

Thus, two samples were obtained, one was Sample No. 101 where Emulsion (A) was incorporated in the third emulsion layer, and the other was Sample No. 102 where Emulsion (D) was incorporated in the third emulsion layer.

These samples were subjected to gradation exposure for sensitometry with an enlarger (Fuji Color Head 609 by Fuji Photo Film Co., Ltd.) and then developed in accordance with the following processing steps:

| Processing Step | Temperature (°C.) | Time (min) |
|---|---|---|
| Development | 33 | 3.5 |
| Bleach-Fix | 33 | 1.5 |
| Rinsing | 28–35 | 3.0 |

The composition of the processing solution used in each step was as follows:

| | |
|---|---|
| Developer: | |
| 3Na.Nitrilotriacetate | 2.0 g |
| Benzyl Alcohol | 15 ml |
| Diethylene Glycol | 10 ml |
| $Na_2SO_3$ | 2.0 g |
| KBr | 0.5 g |
| Hydroxylamine Sulfate | 3.0 g |
| 4-Amino-3-methyl-N—ethyl-N—[β-(methanesulfonamido)ethyl]-p-phenylenediamine Sulfate | 5.0 g |
| $Na_2CO_3$ (monohydrate) | 30 g |
| Water to make | 1 liter |
| | pH 10.1 |
| Bleach-Fix Solution: | |
| Ammonium Thiosulfate (54 wt %) | 150 ml |
| $Na_2SO_3$ | 15 g |
| $NH_4[Fe(EDTA)]$ | 55 g |
| EDTA.2Na | 4 g |
| Water to make | 1 liter |
| | pH 6.9 |

The magenta color density of each sample was measured and the results are given in the following Table 4.

TABLE 4

| Sample No. | Sensitivity | Fog | Desensitization by Pressure | Remarks |
|---|---|---|---|---|
| 101 | 100 | 0.09 | 100 | Comparison |
| 102 | 171 | 0.09 | 100 | Invention |

In the measurement of the desensitization by pressure, the folded angle was 70°.

EXAMPLE 6

30 g of lime-processed gelatin was added to 1,000 ml of distilled water and dissolved therein by warming it to 40° C. Thereto, 6.5 g of sodium chloride was added and heated to 55° C. Then, both a solution containing 62.5 g of silver nitrate in 750 ml of distilled water and a solution containing 4.4 g of potassium bromide and 19.4 g of sodium chloride in 500 ml of distilled water were added dropwise to the above-described gelatin solution with stirring over a period of 40 minutes as a temperature of the mixture was kept at 55° C. To the resulting dispersion were further added a solution containing 62.5 g of silver nitrate in 500 ml of distilled water and a solution containing 4.4 g of potassium bromide and 19.4 g of sodium chloride in 300 ml of distilled water over a 20 minute period under a temperature maintained at 55° C. The thus obtained silver chlorobromide emulsion was demineralized and washed with water. Thereafter, it was divided into 6 parts, and three of these parts were chemically sensitized under their respective conditions as shown in Table 5 to prepare Emulsions (W), (X) and (Y). These emulsions each was coated, optically exposed and developed in the same manner as in Example 1. The results obtained are also shown in Table 5.

Emulsion (X) and Emulsion (Y) in accordance with the present invention, which had received sulfur sensitization under the condition that the silver halide grains had been undergoing transhalogenation by the addition of potassium bromide, proved to be highly sensitive and excellent in properties.

TABLE 5

| Emulsion | Condition in Chemical Ripening (60° C., 40 minutes): Sodium Thiosulfate (mg) | Potassium Bromide (g) | Results: Sensitivity | Fog | Desensitization by Pressure | Remarks |
|---|---|---|---|---|---|---|
| (W) | 0.5 | — | 100 | 0.03 | 89 | Comparison |
| (X) | 0.5 | 0.14 (⊖ 2 min) | 148 | 0.03 | 86 | Invention |
| (Y) | 0.5 | 0.14 (⊕ 10 min) | 135 | 0.03 | 87 | Invention |

The time as shown in the column of potassium bromide means the time of the addition of the potassium bromide, which was counted on the basis of the added time (0 min) of sodium thiosulfate. ⊖ means "before" and ⊕ means "after".

EXAMPLE 7

30 g of lime-processed gelatin was added to 1,000 ml of distilled water, and dissolved therein by warming it to 40° C. Thereto, 6.5 g of sodium chloride was added and heated to 52.5° C. Then, both a solution containing 62.5 g of silver nitrate in 750 ml of distilled water and a solution containing 21.5 g of sodium chloride in 500 ml of distilled water were admixed with the above-described gelatin solution over a period of 40 minutes as a temperature of the mixture was kept at 52.5° C. To the resulting dispersion were further added a solution containing 62.5 g of silver nitrate in 500 ml of distilled water and a solution containing 21.5 g of sodium chloride in 300 ml of distilled water over 20 minutes under a temperature maintained at 52.5° C. The thus obtained silver chloride emulsion was demineralized and washed with water. Thereafter, it was divided into 6 parts, and four of these parsts were chemically sensitized under their respective conditions as shown in Table 6 to prepare Emulsions ($Z_1$) to ($Z_4$). These emulsions each was coated, optically exposed and development processed in the same manner as in Example 1. The results obtained are shown in Table 6.

Emulsions ($Z_2$), ($Z_3$) and ($Z_4$) in accordance with the present invention, which had been subjected to sulfur sensitization along with transhalogenation by the addition of potassium bromide, proved to be highly sensitive to light.

TABLE 6

| Emulsion | Condition in Chemical Ripening (60° C., 40 minutes): Sodium Thiosulfate (mg) | Potassium Bromide (g) | Results: Sensitivity | Fog | Remarks |
|---|---|---|---|---|---|
| ($Z_1$) | 0.35 | — | 100 | 0.03 | Comparison |
| ($Z_2$) | 0.35 | 0.07 | 123 | 0.03 | Invention |
| ($Z_3$) | 0.35 | 0.14 | 138 | 0.03 | Invention |
| ($Z_4$) | 0.35 | 0.28 | 142 | 0.02 | Invention |

Potassium bromide and sodium thiosulfate were added at the same time.

EXAMPLE 8

30 g of lime-processed gelatin was added to 1,000 ml of distilled water, and dissolved therein by warming it to 40° C. Thereto, 6.5 g of sodium chloride was added and heated to 52.5° C. Then, both a solution containing 62.5 g of silver nitrate in 750 ml of distilled water and a solution containing 21.5 g of sodium chloride in 500 ml of distilled water were admixed with the above-described gelatin solution over a period of 40 minutes as a temperature of the mixture was kept at 52.5° C. To the resulting dispersion were further added a solution containing 61.25 g of silver nitrate in 490 ml of distilled water and a solution containing 21.2 g of sodium chloride in 294 ml of distilled water over a 19.5 minute period under a temperature maintained at 52.5° C. Furthermore, a solution containing 1.25 g of silver nitrate in 10 ml of distilled water and a solution containing 0.88 g of potassium bromide in 6 ml of distilled water were admixed with the above-described silver chloride emulsion for 30 seconds. The thus obtained emulsion was demineralized, washed with water, and then subjected to chemical sensitization under the condition shown in Table 7 to prepare Emulsion ($Z_5$).

Separately, a solution containing 0.88 g of potassium bromide in 6 ml of distilled water was added to the same silver chloride emulsion as obtained by the second addition of silver nitrate and sodium chloride solutions in Example 7 at the stage of a two minute lapse after the conclusion of the addition of those solutions. Then, the resulting emulsion was demineralized and washed with water in a similar manner as above, and subsequently chemically sensitized under the condition as shown in Table 7 to prepare Emulsion ($Z_6$).

These Emulsions ($Z_5$) and ($Z_6$), and Emulsion ($Z_3$) obtained in Example 7 were all similar in that they are silver chlorobromide emulsions having a bromide content of about 1 mol %. These emulsions were coated, optically exposed and development-processed in the same manner as in Example 1. The results obtained are shown in Table 7.

An advantage in that transhalogenation is carried out during sulfur sensitization is evident from the result that Emulsion ($Z_3$) in accordance with the present invention had the highest sensitivity.

TABLE 7

| Emulsion | Condition in Chemical Ripening (60° C., 40 minutes) Sodium Thiosulfate (mg) | Potassium Bromide (g) | Results Sensitivity | Fog | Remarks |
|---|---|---|---|---|---|
| ($Z_3$) | 2.1 | 0.88 | 132 | 0.03 | Invention |
| ($Z_5$) | 2.1 | — | 100 | 0.03 | Comparison |
| ($Z_6$) | 2.1 | — | 102 | 0.03 | Comparison |

Potassium bromide and sodium thiosulfate were added at the same time.

EXAMPLE 9

On a paper support laminated with polyethylene on both sides were coated the layers described below to prepare a multilayer multicolor photographic printing paper. Coating compositions for forming constituent layers were prepared as follows:

Preparation of a coating composition for the first layer was illustrated in detail below.

To a mixture of 19.1 g of Yellow Coupler (a) and 4.4 g of Color Image Stabilizer (b) were added 27.2 ml of ethyl acetate and 7.9 ml of Solvent (c) to prepare a solution. This solution was dispersed, in an emulsified condition, into 185 ml of a 10% gelatin aqueous solution containing 8 ml of a 10% water solution of sodium dodecylbenzenesulfonate. Separately, a blue-sensitive sensitizing dye as illustrated below was added to a silver chlorobromide emulsion (bromide content: 1.0 mol %, silver content: 70 g per kg of emulsion) in an amount of $5.0\times10^{-4}$ mol per mol of silver. The resulting emulsion was mixed homogeneously with the foregoing emulsified dispersion so as to have the composition for the first layer described below.

In analogy with the first layer, the second to seventh layers were prepared.

In each of the layers, sodium salt of 1-oxy-3,5-dichloro-s-triazine was used as a gelatin hardener.

Spectrally sensitizing dyes emplyed in emulsion layers sensitive to colors corresponding thereto are illustrated below:

Blue-Sensitive Emulsion Layer

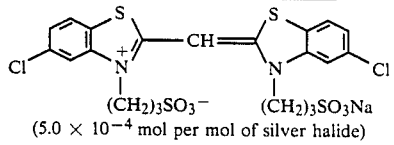

($5.0\times10^{-4}$ mol per mol of silver halide)

Green-Sensitive Emulsion Layer

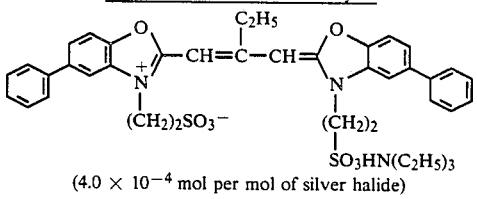

($4.0\times10^{-4}$ mol per mol of silver halide)

and

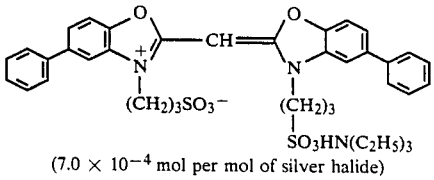

($7.0\times10^{-4}$ mol per mol of silver halide)

Red-Sensitive Emulsion Layer

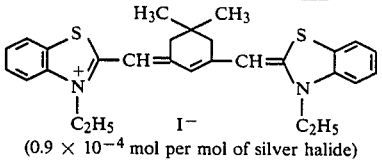

($0.9\times10^{-4}$ mol per mol of silver halide)

For the purpose of preventing an irradiation phenomenon from occurring, the dyes illustrated below were added to each emulsion layer.

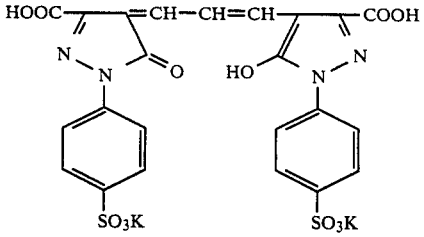

and

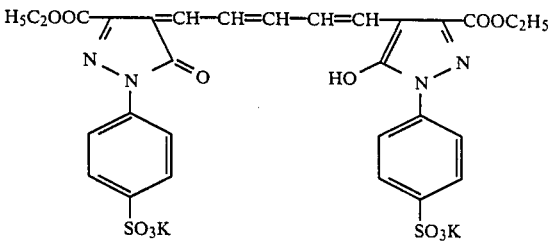

Structural formulae of couplers and other additives used in this example are illustrated below.

(a) Yellow Coupler

-continued
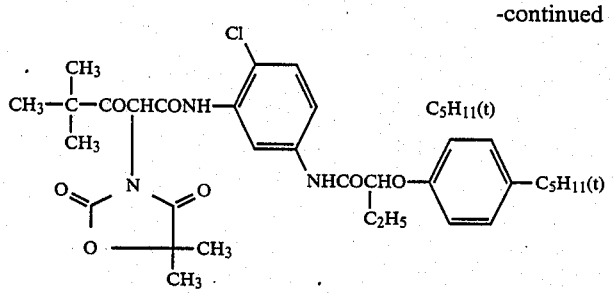
(b) Color Image Stabilizer
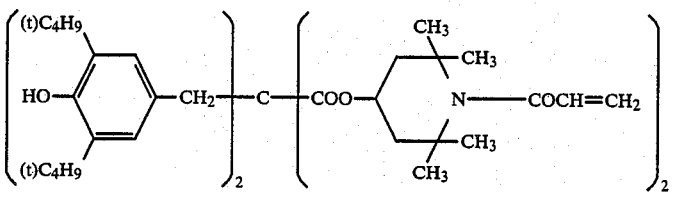
(c) Solvent
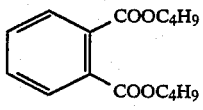
(d) Color Mixing Preventing Agent
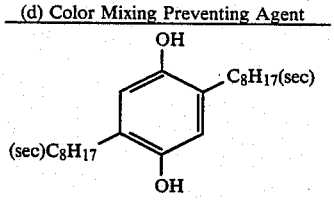
(e) Magenta Coupler
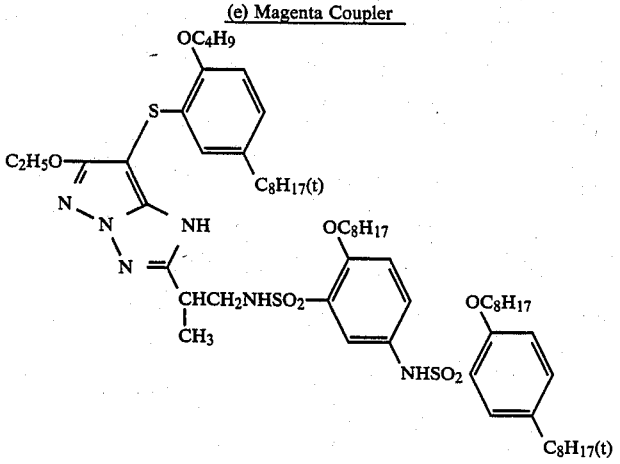
(f) Color Image Stabilizer
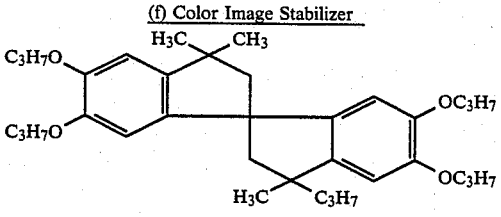
(g) Solvent
2:1 (by weight) mixture of $(C_8H_{17}O)_3P{=}O$
and -continued
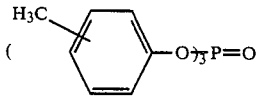
(h) Ultraviolet Absorbent
1:5:3 (by mol) mixture of
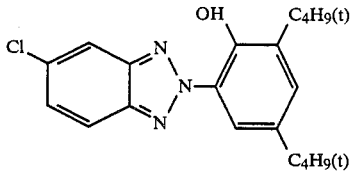
and
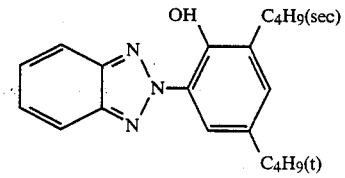
and
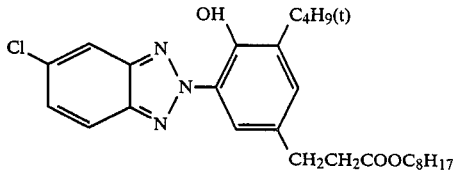
(i) Color Mixing Preventing Agent
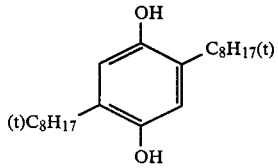
(j) Solvent
$(iso C_9H_{18}O)_3P{=}O$
(k) Cyan Coupler
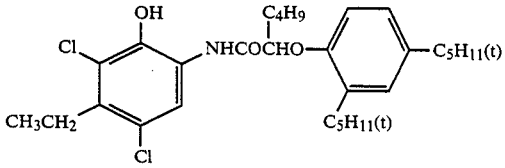
(l) Color Image Stabilizer
1:3:3 (by mol) mixture of
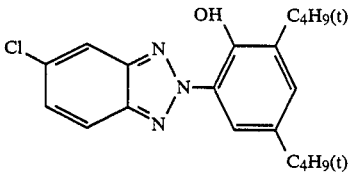
and -continued

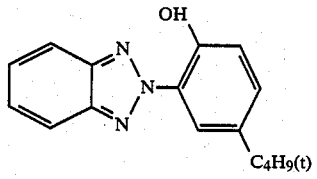

and

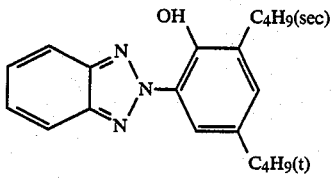

| | |
|---|---|
| **Seventh Layer: Protective Layer** | |
| Gelatin | 1.33 g/m$^2$ |
| Acryl denatured copolymer of polyvinyl alcohol (denaturing degree: 17%) | 0.17 g/m$^2$ |
| **Sixth Layer: Ultraviolet Absorbent Layer** | |
| Gelatin | 0.54 g/m$^2$ |
| Ultraviolet Absorbent (h) | 0.21 g/m$^2$ |
| Solvent (j) | 0.09 ml/m$^2$ |
| **Fifth Layer: Red-Sensitive Layer** | |
| Silver chlorobromide emulsion (bromide content: 1.0 mol %) ($Z_3$), ($Z_5$) or ($Z_6$) | 0.24 g/m$^2$ |
| Gelatin | 0.96 g/m$^2$ |
| Cyan Coupler (k) | 0.38 g/m$^2$ |
| Color Image Stabilizer (l) | 0.17 g/m$^2$ |
| Solvent (c) | 0.23 ml/m$^2$ |
| **Fourth Layer: Ultraviolet Absorbent Layer** | |
| Gelatin | 1.60 g/m$^2$ |
| Ultraviolet Abosrbent (h) | 0.62 g/m$^2$ |
| Color Mixing Preventing Agent (i) | 0.05 g/m$^2$ |
| Solvent (j) | 0.26 ml/m$^2$ |
| **Third Layer: Green-Sensitive Layer** | |
| Silver chlorobromide emulsion (bromide content: 1.0 mol %) ($Z_3$), ($Z_5$) or ($Z_6$) | 0.16 g/m$^2$ |
| Gelatin | 1.80 g/m$^2$ |
| Magenta Coupler (e) | 0.45 g/m$^2$ |
| Color Image Stabilizer (f) | 0.20 g/m$^2$ |
| Solvent (g) | 0.45 ml/m$^2$ |
| **Second Layer: Color Mixing Preventing Layer** | |
| Gelatin | 0.99 g/m$^2$ |
| Color Mixing Preventing Agent (d) | 0.08 g/m$^2$ |
| **First Layer: Blue-Sensitive Layer** | |
| Silver chlorobromide emulsion (bromide content: 1.0 mol %) | 0.27 g/m$^2$ |
| Gelatin | 1.86 g/m$^2$ |
| Yellow Coupler (a) | 0.74 g/m$^2$ |
| Color Image Stabilizer (b) | 0.17 g/m$^2$ |
| Solvent (c) | 0.31 ml/m$^2$ |

Support

Polyethylene laminated paper (containing $TiO_2$ and ultramarine in polyethylene laminate on first layer side).

Amounts of silver chlorobromide emulsions are based on silver coverage. The emulsions used had a cubic crystal form, and were all monodispersed emulsions having a variation coefficient of 0.14 or less.

The color photographic paper thus obtained was exposed to light through an optical wedge, and subsequently subjected to the processing including the following steps.

| Processing Step | Time | Temperature (°C.) |
|---|---|---|
| Color Development | 45 sec | 35 |
| Bleach-Fix | 45 sec | 35 |
| Rinsing (4-tank cascade) | 1 min 30 sec | 30 |
| Drying | 50 sec | 80 |

Compositions of the processing solutions used were as follows:

| | |
|---|---|
| **Color Developer:** | |
| Water | 800 ml |
| Diethylenetriaminepentaacetic Acid | 1.0 g |
| Sodium Sulfite | 0.2 g |
| N,N—Diethylhydroxylamine | 4.2 g |
| Potassium Bromide | 0.01 g |
| Sodium Chloride | 1.5 g |
| Triethanolamine | 8.0 g |
| Potassium Carbonate | 30 g |
| N—Ethyl-N—(β-methanesulfonamidoethyl)-3-methyl-4-aminoaniline Sulfate | 4.5 g |
| Brightening Agent of 4,4'-Diaminostilbene Type (Whitex 4, trade name of Sumitomo Chemical Co., Ltd.) | 2.0 g |
| Water to make | 1,000 ml |
| KOH to adjust to pH | 10.25 |
| **Bleach-Fix Solution:** | |
| Water | 400 ml |
| Ammonium Thiosulfate (70%) | 150 ml |
| Sodium Sulfite | 18 g |
| Ammonium Ethylenediaminetetraacetato Ferrate | 55 g |
| Ethylenediaminetetraacetic Acid | 5 g |
| Water to make | 1,000 ml |
| pH adjusted to | 6.75 |
| **Rinsing Solution:** | |
| 1-Hydroxyethylidene-1,1-disulfonic Acid (60%) | 1.5 ml |
| Nitrilotriacetic Acid | 1.0 g |
| Ethylenediaminetetraacetic Acid | 0.5 g |
| Ethylenediamine-N,N,N',N'—tetramethylene-phosphonic Acid | 1.0 g |
| Bismuth Chloride (40%) | 0.5 g |
| Magnesium Sulfate | 0.2 g |
| Zinc Sulfate | 0.3 g |
| Ammonium Alum | 0.5 g |
| 5-Chloro-2-methyl-4-isothiazoline-3-one | 30 mg |
| 2-Methyl-4-isothiazoline-3-one | 10 mg |
| 2-Octyl-4-isothiazoline-3-one | 10 mg |
| Ethylene Glycol | 1.5 g |
| Sulfonyamide | 0.1 g |
| 1,2,3-Benzotriazole | 1.0 g |
| Ammonium Sulfite (40%) | 1.0 g |
| Aqueous Ammonia (26%) | 2.6 ml |
| Polyvinylpyrrolidone | 1.0 g |

-continued

| | |
|---|---|
| Brightening Agent of 4,4'-Diaminostilbene Type | 1.0 g |
| Water to make | 1,000 ml |
| KOH to adjust pH to | 7.0 |

In this example, three kinds of samples were prepared using Emulsions ($Z_3$), ($Z_5$) and ($Z_6$), respectively, which properties had been examined in Example 8, as the silver chlorobromide emulsion to constitute the fifth layer and the third layer. To make an additional remark, the same emulsion was employed in both fifth and third layers in each sample. The thus obtained samples were named (Z-III), (Z-V) and (Z-VI).

The results obtained using these samples are shown in Table 8.

Sample (Z-III) in which Emulsion ($Z_3$) in accordance with the present invention were used was proved to be excellent in sensitivity with respect to both red-sensitive and green-sensitive layers.

TABLE 8

| Sample | Emulsion | Layer | Sensitivity | Fog | Remarks |
|---|---|---|---|---|---|
| (Z-III) | ($Z_3$) | Red-Sensitive Layer | 130 | 0.07 | Invention |
| | | Green-Sensitive Layer | 145 | 0.08 | |
| (Z-V) | ($Z_5$) | Red-Sensitive Layer | 100 | 0.08 | Comparison |
| | | Green-Sensitive Layer | 100 | 0.10 | |
| (Z-VI) | ($Z_6$) | Red-Sensitive Layer | 98 | 0.08 | Comparison |
| | | Green-Sensitive Layer | 102 | 0.09 | |

EXAMPLE 10

To each of the same emulsions as ($Z_3$) prepared in Example 7, ($Z_5$) and ($Z_6$) prepared in Example 8 was added 42 mg of chloroauric acid after a 1 minute lapse from the addition of sodium thibsulfate for chemical ripening. The chemical ripening was carried out under the same condition as in Example 8. The thus obtained emulsions were named ($Z_7$), ($Z_8$) and ($Z_9$) in the order of the above description. These emulsions were coated, optically exposed, and development-processed in the same manner as in Example 1. The results obtained are shown in Table 9.

TABLE 9

| Emulsion | Sensitivity | Fog | Remarks |
|---|---|---|---|
| ($Z_7$) | 151 | 0.04 | Invention |
| ($Z_8$) | 100 | 0.05 | Comparison |
| ($Z_9$) | 107 | 0.04 | Comparison |

In the case where the emulsions were subjected to both sulfur sensitization and gold sensitization, Emulsion ($Z_7$), which had received such chemical sensitizations under transhalogenation, was proved to gain the highest sensitivity similarly to the case where sulfur sensitization alone were carried out.

The sensitivities are shown as relative values in Examples 6 to 10, with Emulsions (W), ($Z_1$), ($Z_5$), and ($Z_8$) respectively being taken as 100.

EXAMPLE 11

Samples (Z-VII), (Z-VIII) and (Z-IX) were prepared in the same manner as in Example 9 except that Emulsions ($Z_7$), ($Z_8$) and ($Z_9$) prepared in Example 10 were used in place of Emulsions ($Z_3$), ($Z_5$) and ($Z_6$), respectively.

These samples were subjected to the same processings as in Example 9, and the results shown in Table 10 were obtained. To make an additional remark, as for the counter ion of the sensitizing dye incorporated in the red-sensitive layer, bromine ion was substituted for iodine ion in Example 9.

TABLE 10

| Sample | Emulsion | Layer | Sensitivity | Fog | Remarks |
|---|---|---|---|---|---|
| (Z-VII) | ($Z_7$) | Red-Sensitive Layer | 162 | 0.09 | Invention |
| | | Green-Sensitive Layer | 166 | 0.09 | |
| (Z-VIII) | ($Z_8$) | Red-Sensitive Layer | 100 | 0.09 | Comparison |
| | | Green-Sensitive Layer | 100 | 0.10 | |
| (Z-IX) | ($Z_9$) | Red-Sensitive Layer | 109 | 0.09 | Comparison |
| | | Green-Sensitive Layer | 105 | 0.10 | |

The sensitivities are shown as relative values, with Sample (Z-VIII) being taken as 100.

As can be seen from the results in Table 10, Sample (Z-VII) prepared in accordance with the present invention, in which the red-sensitive and green-sensitive emulsions sensitized chemically as they underwent transhalogenation were used, and the chemical sensitization included not only sulfur sensitization but also gold sensitization, achieved higher sensitivity.

While the invention has been described in detail and with reference to specific embodiments thereof, it will be apparent to one skilled in the art that various changes and modifications can be made therein without departing from the spirit and scope thereof.

What is claimed is:

1. A silver halide photographic material comprising a support having provided thereon a sulfur-sensitized silver halide emulsion, wherein the silver halide particles in the emulsion as formed by the reaction of a water-soluble silver salt and a water-soluble halide are, after demineralization, subjected to transhalogenation along with sulfur sensitization by the addition of a water-soluble bromide to the emulsion in an amount of 0.1 mol % to 7 mol % of the total amount of the silver halide therein just before or during the sulfur sensitization.

2. A silver halide photographic material of claim 1, wherein the water-soluble bromide is added to the emulsion in an amount of 0.2 mol % to 3 mol %.

3. A silver halide photographic material of claim 1, wherein the water-soluble bromide is an alkali metal or ammonium bromide.

4. A silver halide photographic material of claim 1, wherein the silver halide prior to transhalogenation is a silver halide containing silver chloride which is converted into silver bromide by bromide ions.

5. A silver halide photographic material of claim 1, wherein the sulfur sensitization reaction and the transhalogenation reaction proceed at the same time.

6. A silver halide photographic material of claim 1, wherein the transhalogenation just proceeds when sensitized nuclei are beginning to be formed on the surface of the silver halide particles by the sulfur sensitization reaction.

7. A silver halide photographic material of claim 1, wherein the sulfur sensitization is performed with a gold sensitization.

8. A silver halide photographic material of claim 1, wherein the sulfur sensitized silver halide particles are monodispersed silver halide particles having a variation coefficient of 0.15 or less.

9. A silver halide photographic material of claim 8, wherein the variation coefficient is 0.10 or less.

10. A silver halide photographic material of claim 1, wherein at least 50% of the sulfur-sensitized silver halide particles are regular crystals.

11. A silver halide photographic material of claim 1, wherein after transhalogenation the silver halide is silver chlorobromide.

12. A silver halide photographic material of claim 1, wherein the sulfur sensitization is begun before the addition of the water-soluble bromide.

13. A silver halide photographic material of claim 1, wherein after transhalogenation the silver halide is silver chlorobromide and the sulfur sensitization is begun before the addition of the water-soluble bromide.

* * * * *